US010850413B2

(12) United States Patent
Mortensen

(10) Patent No.: US 10,850,413 B2
(45) Date of Patent: Dec. 1, 2020

(54) ROTARY CUTTER SAFETY INSERT

(71) Applicant: Bennett Alan Mortensen, Cedaredge, CO (US)

(72) Inventor: Bennett Alan Mortensen, Cedaredge, CO (US)

( * ) Notice: Subject to any disclaimer, the term of this patent is extended or adjusted under 35 U.S.C. 154(b) by 121 days.

(21) Appl. No.: 15/890,149

(22) Filed: Feb. 6, 2018

(65) Prior Publication Data

US 2019/0240853 A1 Aug. 8, 2019

(51) Int. Cl.
*B26B 25/00* (2006.01)
*B26B 29/02* (2006.01)
*D06H 7/00* (2006.01)

(52) U.S. Cl.
CPC ..... *B26B 25/005* (2013.01); *B26B 29/02* (2013.01); *D06H 7/00* (2013.01)

(58) Field of Classification Search
CPC ..... B26B 25/005; B26B 29/02; D06H 7/00
USPC ..... 30/164.95, 292, 306, 307, 319; D7/693–695
See application file for complete search history.

(56) References Cited

U.S. PATENT DOCUMENTS 594,776 A * 11/1897 Burnham ..... B26B 29/02 30/319
623,000 A * 4/1899 Erkenbreck ..... B26B 25/00 30/292
900,300 A * 10/1908 Nicolas ..... B26B 29/02 30/319
951,331 A * 3/1910 Ohmart ..... B26B 3/04 30/307
1,108,161 A * 8/1914 Field ..... B26B 25/00 30/292
1,358,973 A * 11/1920 Minarcik ..... B26B 25/005 30/307
1,594,963 A * 8/1926 James ..... B26B 27/005 30/292
1,864,658 A * 6/1932 McConnell ..... B24B 53/14 30/319
1,865,242 A * 6/1932 Eldredge ..... C03B 33/12 30/164.95
2,254,162 A * 8/1941 Wyman ..... C03B 33/12 30/164.95
2,568,353 A * 9/1951 Miseta, Jr. ..... B44C 7/025 30/319
3,003,238 A * 10/1961 Olson ..... A01G 3/06 30/319
4,020,550 A * 5/1977 Okada ..... B26B 25/005 30/292
4,062,116 A * 12/1977 Arnott ..... B26B 25/005 30/292
4,098,156 A * 7/1978 Insolio ..... C03B 33/10 30/164.95
4,301,594 A * 11/1981 Okada ..... B26B 25/005 30/164.95
5,299,355 A * 4/1994 Boda ..... B26B 25/005 30/292

(Continued)

*Primary Examiner* — Jason Daniel Prone
(74) *Attorney, Agent, or Firm* — Travis R. Banta; TechLaw Ventures, PLLC

(57) ABSTRACT

A rotary cutter insert can include a body configured to cover a first portion of a surface of a rotary blade. Further, the body of the rotary cutter insert can have an angled cutout configured to expose a second portion of the surface of the rotary blade so a rotary cutter can be used while the rotary cutter insert is in place. The rotary cutter insert reduces the area of exposed rotary blade that could potentially injure a user, thus making the rotary cutter significantly safer.

7 Claims, 7 Drawing Sheets

(56) References Cited

U.S. PATENT DOCUMENTS 5,355,588 A * 10/1994 Brandenburg, Jr. .... B26B 29/02 30/292
5,632,090 A * 5/1997 Smith ..... B26B 3/08 30/319
5,711,077 A * 1/1998 Schulz ..... B26B 25/005 30/319
5,765,289 A * 6/1998 Schulz ..... B26B 29/02 30/292
6,044,565 A * 4/2000 Arend ..... B26B 29/02 30/292
D430,475 S * 9/2000 Hirai ..... D8/98
6,327,783 B1 * 12/2001 Ming ..... B26B 25/005 30/292
6,643,936 B2 * 11/2003 Carlson ..... B26B 25/005 30/292
7,204,023 B2 * 4/2007 Chang ..... B26B 29/02 30/292
7,290,340 B2 * 11/2007 Lin ..... B26B 25/005 30/292
7,395,602 B2 * 7/2008 Backus ..... A47J 43/283 30/322
7,434,319 B2 * 10/2008 Tsai-Lian ..... B26B 25/005 30/164.95
9,492,934 B2 * 11/2016 Coffland ..... B26B 25/005
9,656,402 B2 * 5/2017 Roth ..... B26B 29/02
2004/0187318 A1 * 9/2004 Mathieu ..... B26B 29/00 30/319
2008/0250654 A1 * 10/2008 Chang ..... B26B 29/02 30/292
2009/0223068 A1 * 9/2009 Sawhney ..... B26B 25/005 30/319
2013/0014394 A1 * 1/2013 Yu Chen ..... B26B 25/005 30/291
2014/0144027 A1 * 5/2014 Roth ..... B26B 29/02 30/164
2017/0341251 A1 * 11/2017 Siciliano ..... B26B 25/005

* cited by examiner

ROTARY CUTTER SAFETY INSERT

BACKGROUND

Sewing and crafting enthusiast often employ the use of rotary cutters to cut textiles and similar materials. Unfortunately, the circular rotary blades can be dangerous for users. Manufacturers of rotary cutters often include a sliding blade guard that covers the blade while the rotary cutter is not in use. However, sliding blade guards are generally not designed to cover the blade while rotary cutter is in use, and therefore the blade can still present a risk of injury to users while they use the rotary cutter. Accordingly, there are problems in the art that can be addressed with respect to rotary cutter safety.

BRIEF SUMMARY

Embodiments of the present disclosure solve one or more problems in the art with an insert configured to protect a user from the blade of a rotary cutter. In particular, in at least one embodiment, the insert includes a body configured to cover a first portion of a surface of the rotary blade. Further, the body of the insert can have an angled cutout configured to expose a second portion of the surface of the rotary blade so the rotary cutter can be used while the insert is in place. The insert reduces the area of exposed blade that could potentially injure a user, thus making the rotary cutter significantly safer.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The present disclosure extends to an insert configured to cover the blade of a rotary cutter. In particular, the insert covers the surface of the rotary blade except for an angled cutout that is designed allow the user to use the rotary cutter while the insert is in place. The insert reduces the area of exposed blade that could potentially injure a user, thus making the rotary cutter significantly safer.

In addition, the rotary cover insert is easy to install on a rotary cutter. Rotary cutters generally have replaceable blades, and are therefore made to dissemble easily so users can replace old or worn blades. The user can install the insert by disassembling the rotary cutter as if the user was replacing the blade, and simply placing the insert between the blade and the rotary cutter body before reassembling the rotary cutter. Further, unlike sliding or rotating blade guards, the present disclosure does not need to be moved before using the rotary cutter.

Figure 1A:
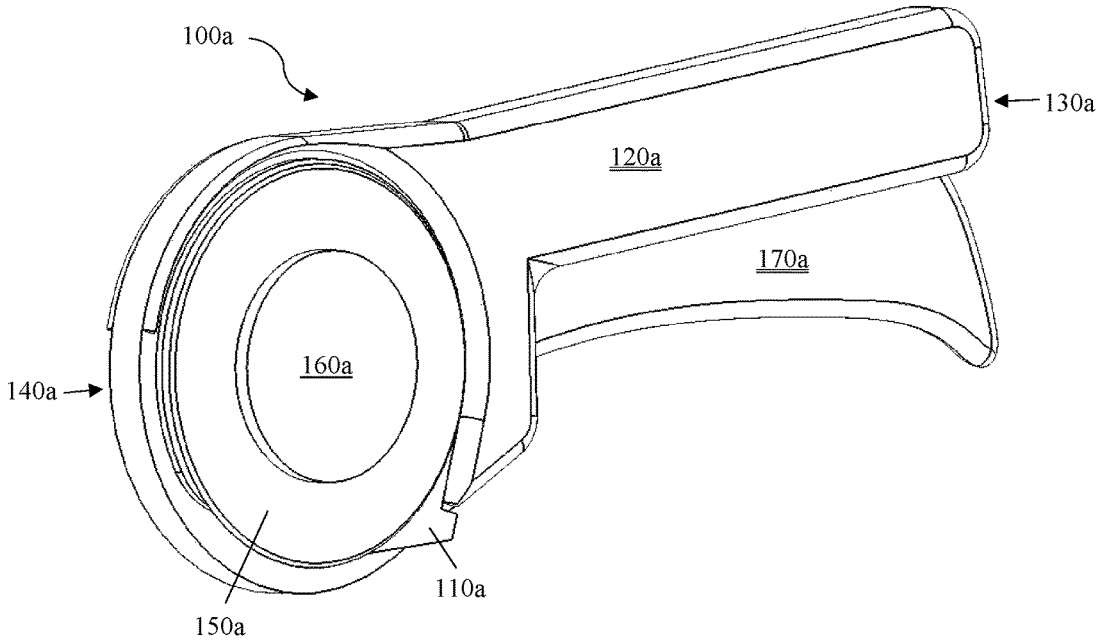
FIG. 1A illustrates a first side perspective view of an exemplary rotary cutter with a rotary cutter insert installed.
Figure 1B:
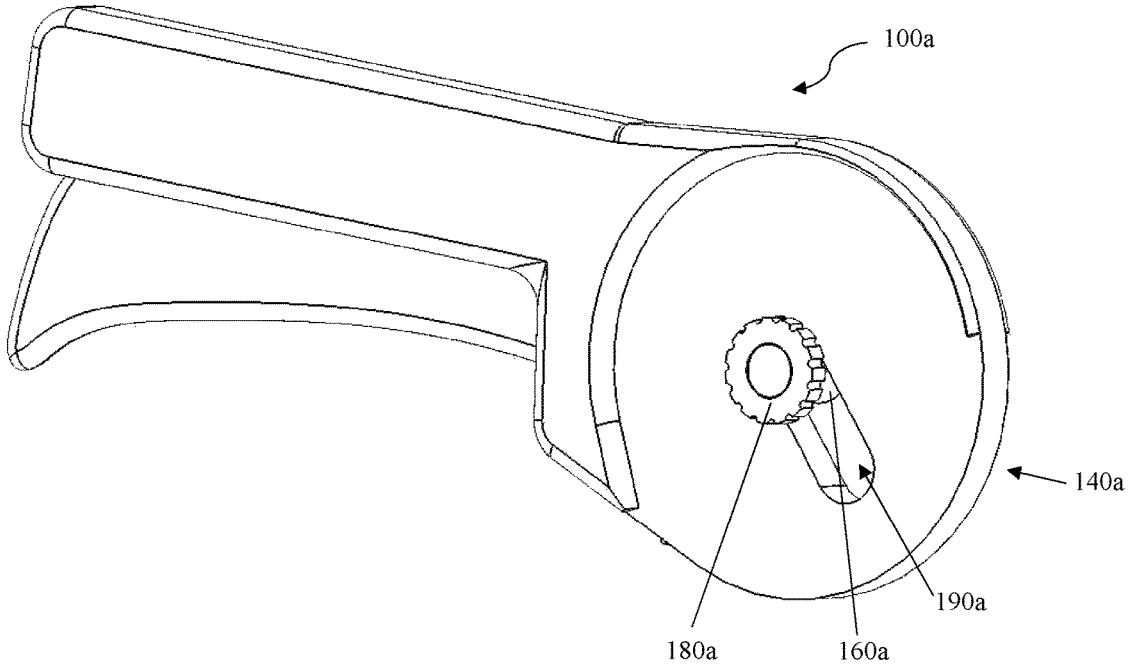
FIG. 1B illustrates a second side perspective view of the exemplary rotary cutter shown in FIG. 1A.

FIGS. 1A and 1B show an exemplary rotary cutter 100*a* with a rotary cutter insert 110*a* installed. As shown, the rotary cutter 100*a* includes a rotary body 120*a* with a proximal end 130*a* and a distal end 140*a*. FIG. 1A further shows that the distal end of the rotary body 140*a* includes a rotary blade 150*a* positioned lateral to the rotary cutter insert 110*a*, and an attachment mechanism 160*a* that secures the rotary cutter insert 110*a* and the rotary blade 150*a* to the distal end of the rotary body 140*a* of the rotary cutter 100*a*. The rotary cutter 100*a* can also include a lever 170*a*, which when engaged, causes the attachment mechanism 160*a*, rotary cutter insert 110*a*, and rotary blade 150*a* to slide into a position where rotary blade 150*a* can be used.

FIG. 1B shows the opposing side of the rotary cutter 100*a* shown in FIG. 1A. As shown, on the opposing side, the distal end of the rotary body 140*a* includes fastening mechanism 180*a* that engages with the attachment mechanism 160*a* to secure the rotary cutter insert 110*a* and rotary blade 150*a* to the rotary cutter 100*a*. FIG. 1B also shows the sliding plane 190*a* along which the fastening mechanism 180*a*, the attachment mechanism 160*a*, rotary cutter insert 110*a*, and the rotary blade 150*a* slide when the lever 170*a* is engaged.

Figure 2A:
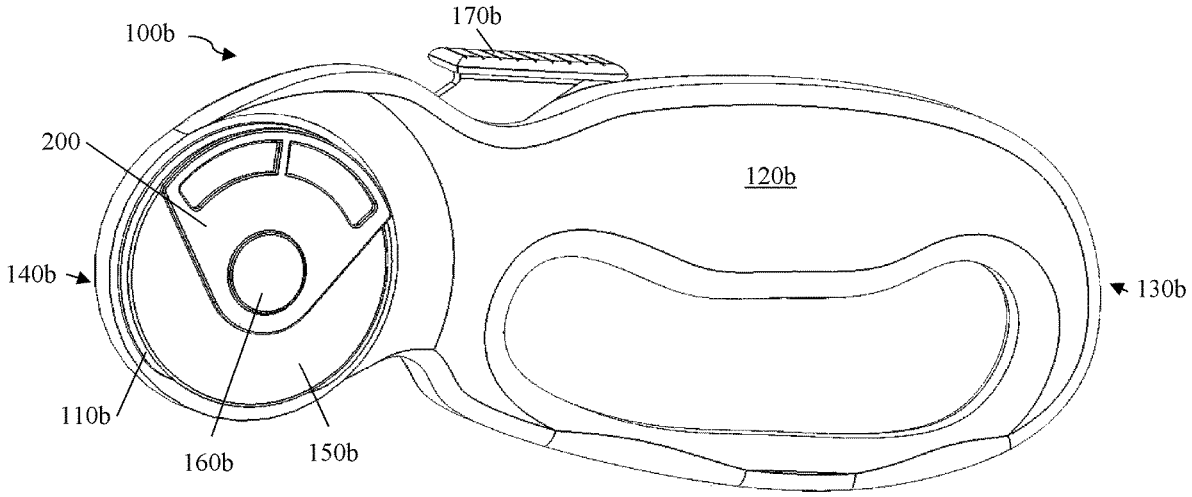
FIG. 2A illustrates a first side perspective view of an exemplary rotary cutter with a rotary cutter insert installed.
Figure 2B:
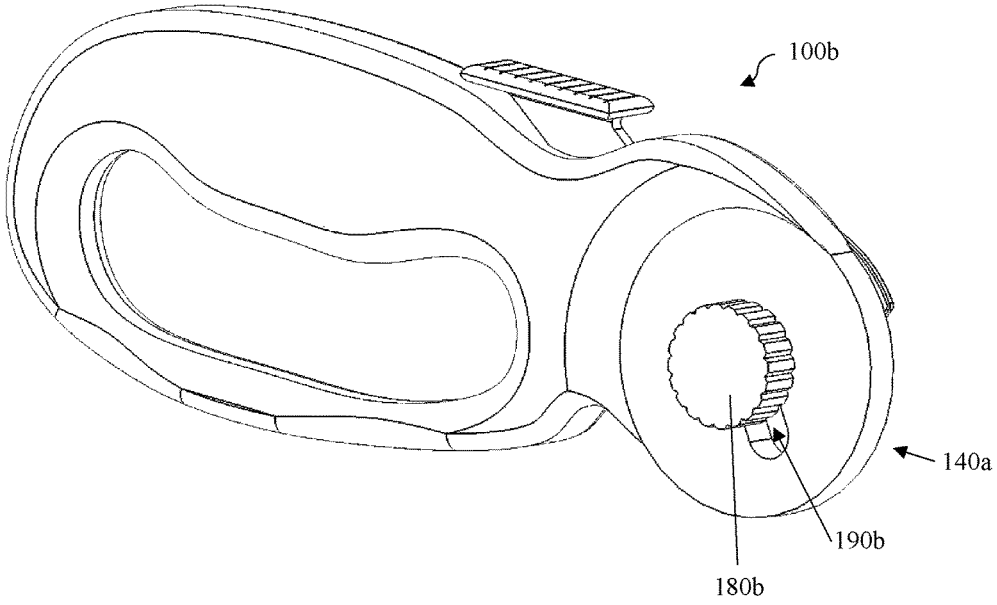
FIG. 2B illustrates a second side perspective view of the exemplary rotary cutter shown in FIG. 2A.

FIGS. 2A and 2B show an alternative exemplary rotary cutter 100*b* with a rotary cutter insert 110*b* installed. Like the rotary cutter 100*a* shown in FIGS. 1A-1B, the rotary cutter 100*b* includes a rotary body 120*b* with a proximal end 130*b* and a distal end 140*b*. The distal end of the rotary body 140*b* further comprises a rotary blade 150*b* on the lateral side of the rotary cutter insert, and an attachment mechanism 160*b* to secure the rotary cutter insert 110*b* and rotary blade 150*b* to the rotary cutter 100*b*. The attachment mechanism can also secure a blade guard 200 on the lateral side of the rotary blade 150*b* to the rotary cutter 100*b*. The rotary cutter 100*b* also includes a 170*b* that when engaged, causes the attachment mechanism 160*b*, rotary cutter insert 110*b*, rotary blade 150*a*, and blade guard 200 to slide into a position where rotary blade 150*b* can be used.

FIG. 2B shows the opposing side of the rotary cutter 100*b* shown in FIG. 2A. As shown, on the opposing side, the distal end of the rotary body 140*b* includes fastening mechanism 180*b* that engages with the attachment mechanism 160*b* to secure the rotary cutter insert 110*b*, rotary blade 150*b*, and blade guard 200 to the rotary cutter 100*a*. FIG. 2B also shows the sliding plane 190*b* along which the fastening mechanism 180*b*, the attachment mechanism 160*b*, rotary cutter insert 110*b*, the rotary blade 150*b*, and blade guard 200 slide when the lever 170*a* is engaged.

FIGS. 1A and 2A show how rotary cutter insert 110*a* surrounds all but a portion of the rotary blade 150. When the lever 170 is engaged, the rotary blade 150 slides into a position where it can be used (e.g. outside the perimeter of the distal end of the rotary body 140), the rotary cutter insert 110*a* continues to cover all but a portion of the rotary blade 150. Even when the rotary blade 150 is in a position where it can be used, the rotary cutter insert 110*a* covers all but the portion of the rotary blade 150 necessary to cut. The reduced exposed blade area of the rotary blade 150 makes the rotary cutter 100 safer to use.

Figure 3:
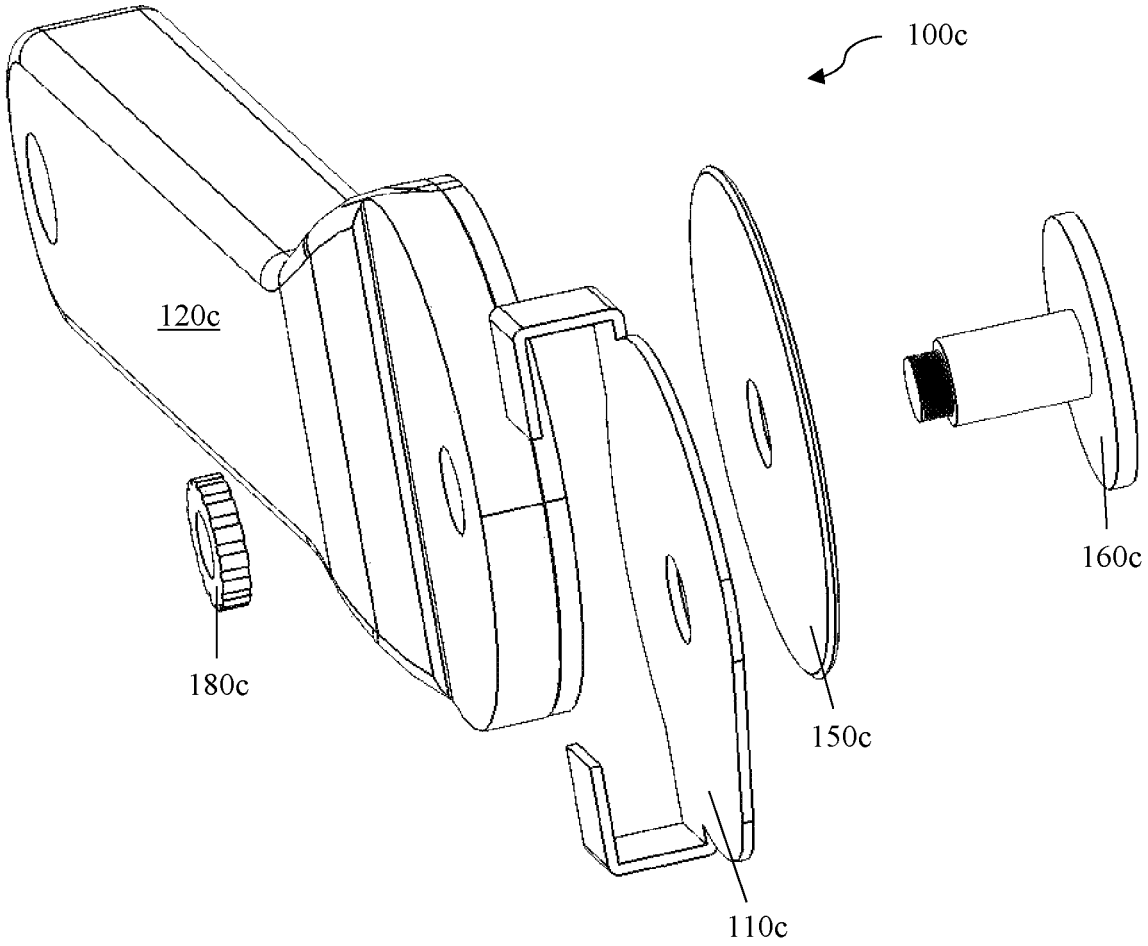
FIG. 3 shows a front exploded view of an exemplary rotary cutter with a rotary cutter insert installed.

FIG. 3 shows an exploded view of exemplary rotary cutter 100*c*. As shown, the manufacturer or user can put the rotary cutter insert 110*c* between the rotary body 120*c* and the rotary blade 150*c*. The rotary cutter insert 110*c* and rotary blade 150*c* can be secured to the rotary body 120*c* using the attachment mechanism 160*c* and the fastening mechanism 180*c*. Although FIG. 3 shows the rotary cutter insert 110*c* between the rotary body 120*c* and rotary blade 150*c*, the present disclosure is not so limited. In at least one implementation, the rotary cutter insert 110*c* is positioned on the lateral side of the rotary blade 150*c*.

The rotary cutters 100 in FIGS. 1A-3 are not limited to the size, shape, configurement, etc. shown in FIGS. 1A-3. Not all the features shown in the FIGS. 1A-3 must be present. For example, the rotary cutter may not have a lever 170. There may also be additional feature included on the rotary cutters 100 that are not shown in the Figures. Further, although FIGS. 1A-3 show the rotary inserts 110*a*-110*c* and rotary blades 150 on the right side of the rotary body 120 from the user's perspective, one skilled in the art will appreciate that the present disclosure is not so limited. The rotary cutter inserts 110*a*-110*c* and rotary blade 150 can be on the right or left side of the rotary body 120.

Figure 4A:
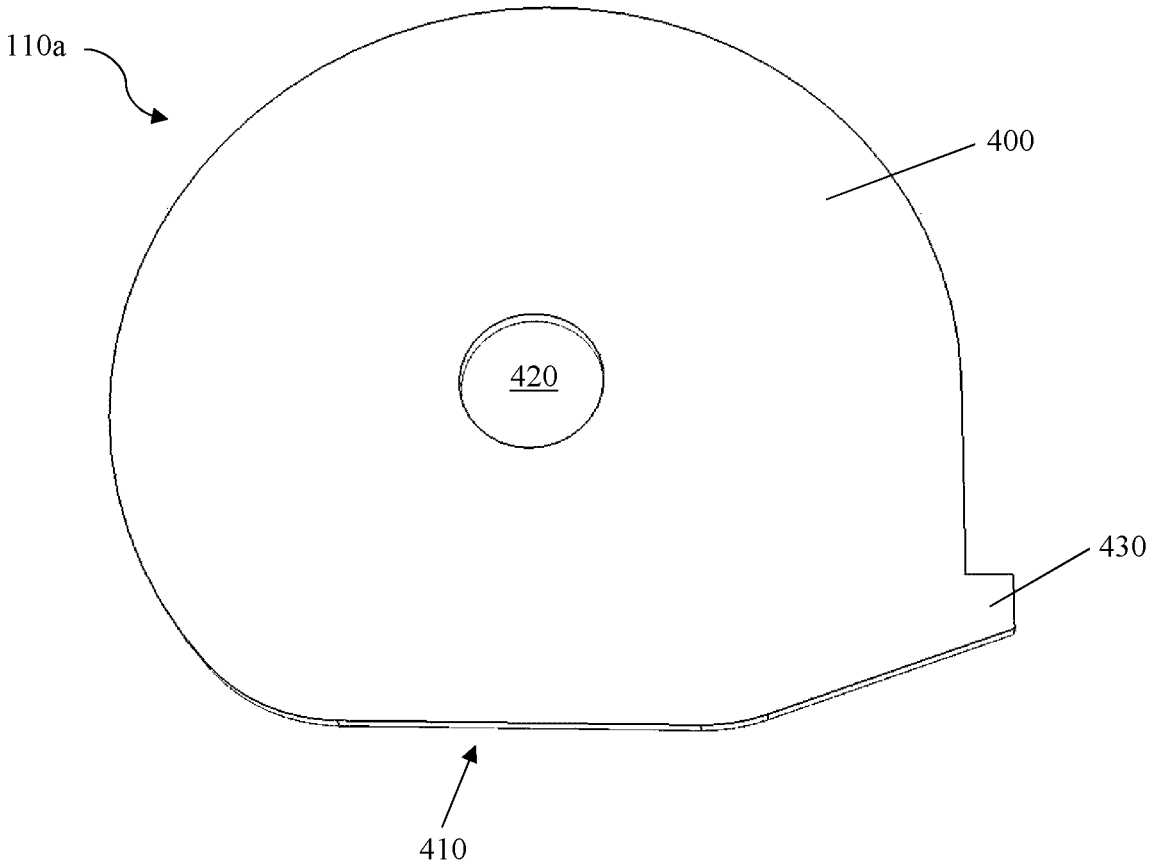
FIG. 4A illustrates a side perspective view of an exemplary rotary cutter insert.
Figure 4B:
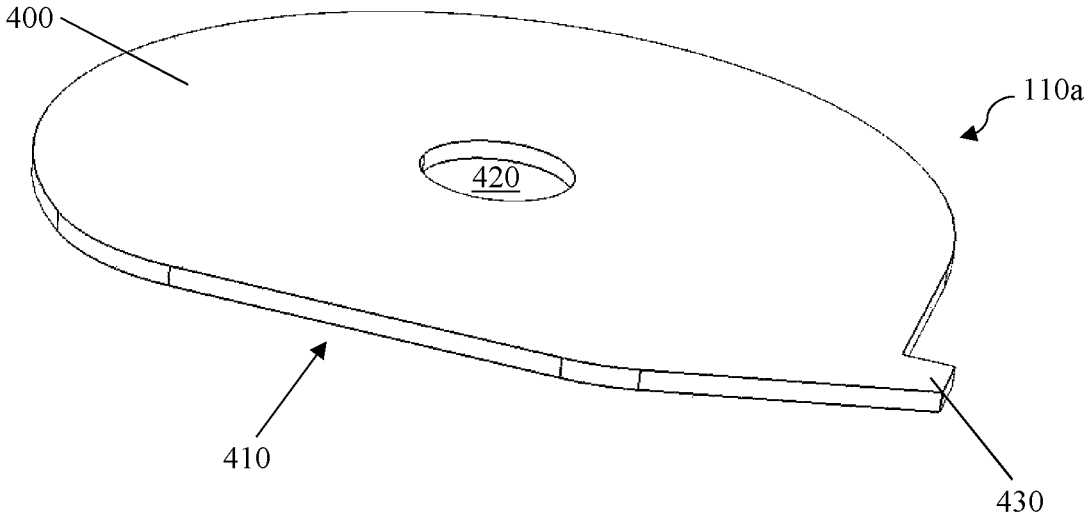
FIG. 4B illustrates a bottom perspective view of the exemplary rotary cutter insert shown in FIG. 4A.

FIGS. 4A and 4B show an exemplary rotary cutter insert 110*a* similar to that shown in FIGS. 1A and 1B. As shown, the rotary cutter insert 110*a* includes a body 400, an angled cutout 410, a central hole 420, and a stabilizing projection 430. The body 400 has an angled cutout 410 configured to expose only the portion of the rotary blade needed to cut. The rotary cutter insert 110*a* includes a central hole 420 that allows the manufacturer or user to attach the insert 110*a* to the rotary cutter. The stabilizing projection 430 is designed to stabilize the insert 110*a* when the insert 110*a* is attached to the rotary cutter.

Figure 5A:
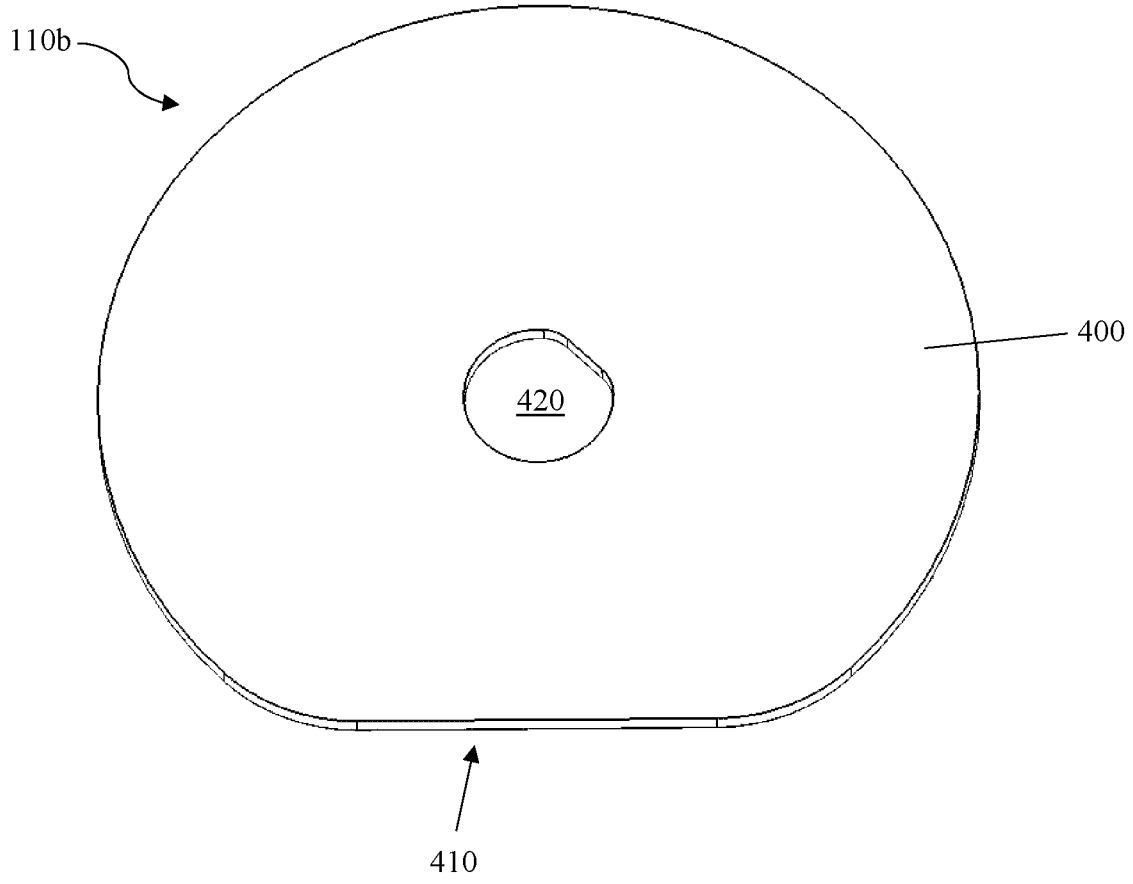
FIG. 5A illustrates a side perspective view of an exemplary rotary cutter insert.
Figure 5B:
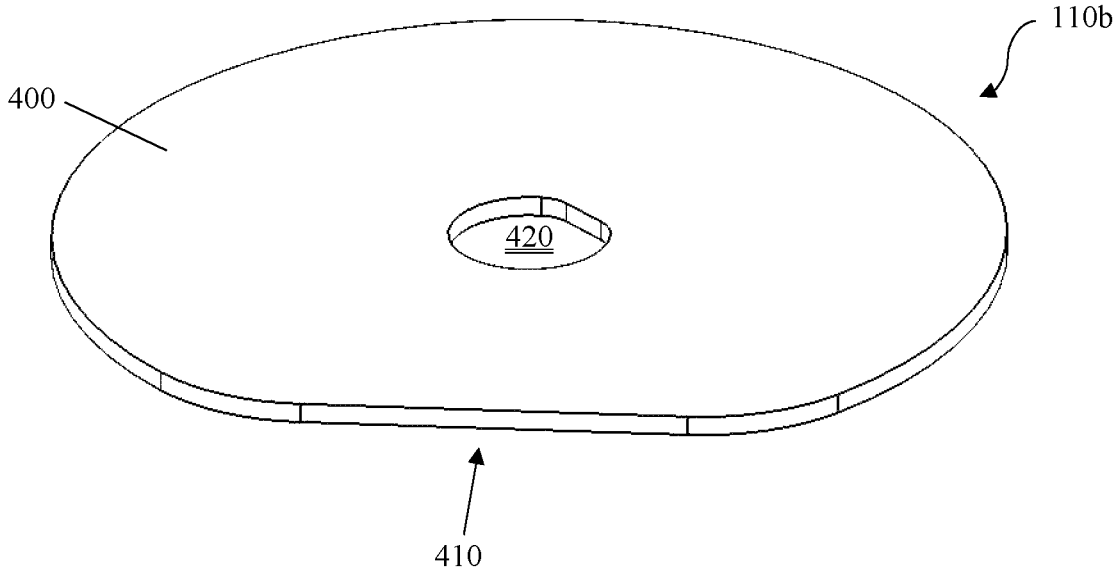
FIG. 5B illustrates a bottom perspective view of the exemplary rotary cutter insert shown in FIG. 5A.

FIGS. 5A and 5B show an exemplary rotary cutter insert 110*b* similar to the rotary cutter insert 110*b* shown in FIGS. 2A and 2B. The rotary cutter insert 110*b* includes a body 400, an angled cutout 410, and a central hole 420. Like the body 400 shown in FIGS. 4A and 4B, the body 400 in FIGS. 5A and 5B have an angled cutout 410 configured to expose only the portion of the rotary blade needed to cut. The central hole 420 is configured to allow the manufacturer or user to attach the rotary cutter insert 110*b* to the rotary cutter.

Figure 6A:
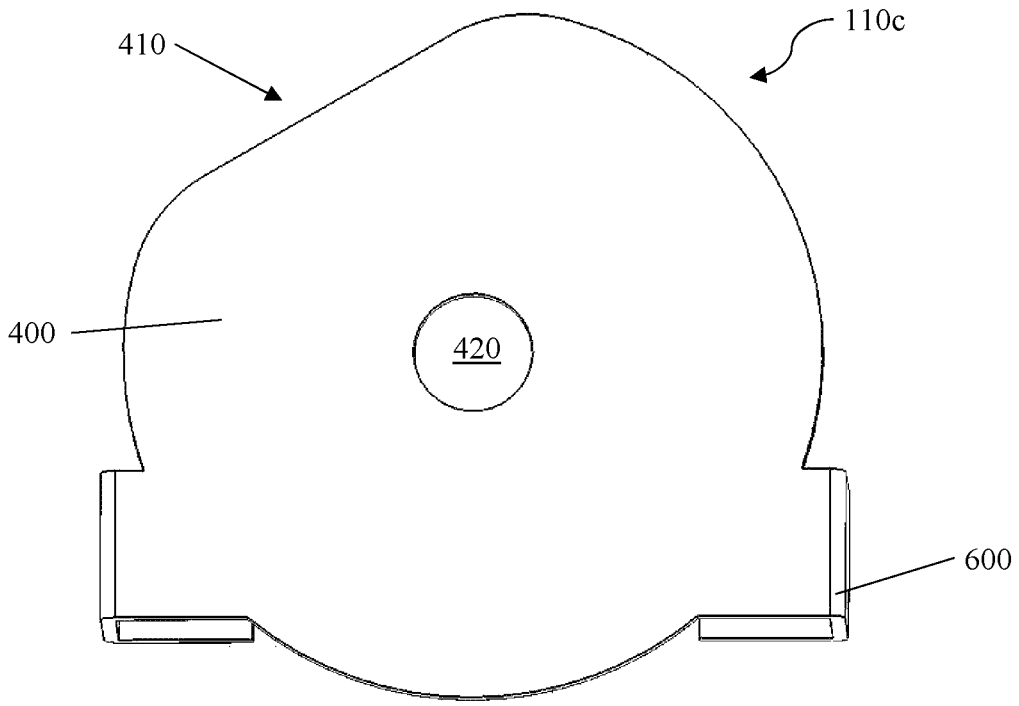
FIG. 6A illustrates a first side perspective view of an exemplary rotary cutter insert.
Figure 6B:
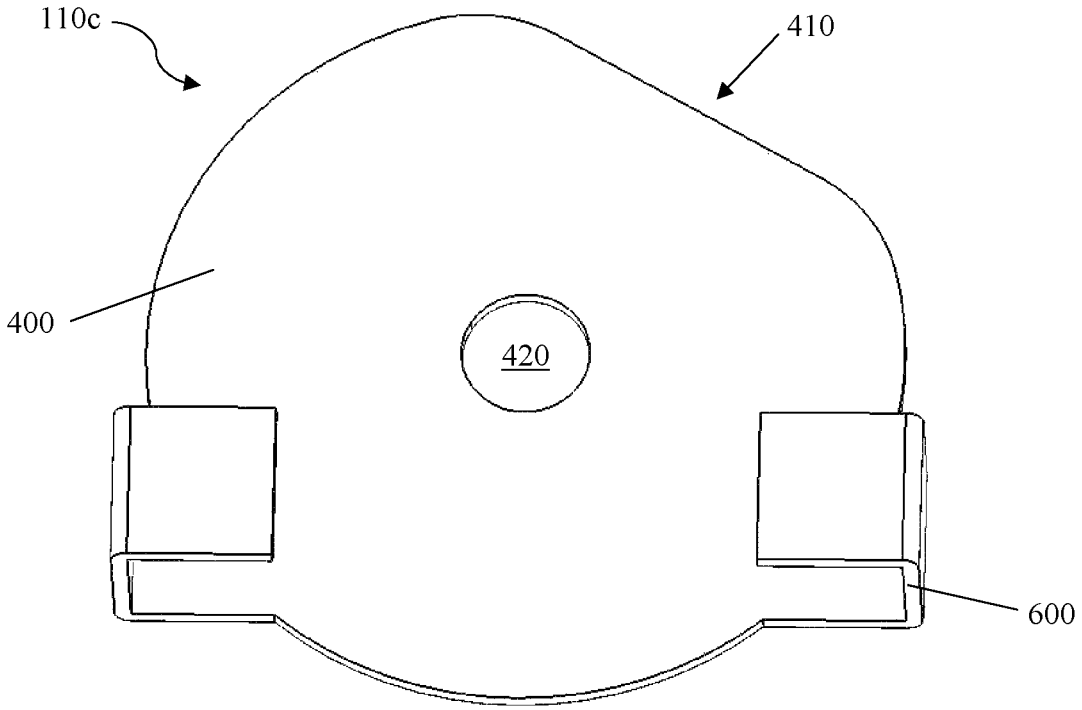
FIG. 6B illustrates a second side perspective view of the exemplary rotary cutter insert shown in FIG. 6A.
Figure 6C:
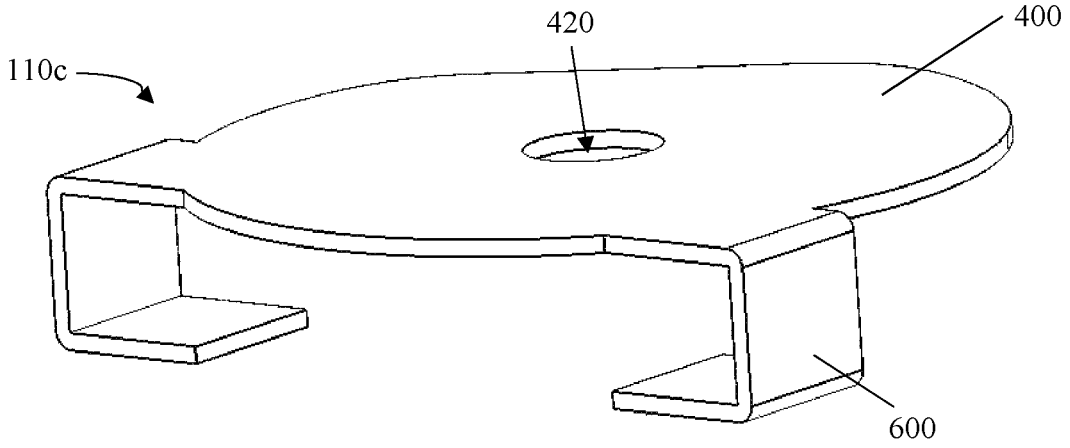
FIG. 6C illustrates a back-perspective view of the exemplary rotary cutter insert shown in FIGS. 6A and 6B.

FIGS. 6A-6C show an exemplary rotary cutter insert 110*c* similar to that shown in FIG. 3. As shown, the rotary cutter insert 110*c* can include a body 400, an angled cutout 410, a central hole 420, and attachment arms 600. As shown, the body 400 has an angled cutout 410 configured to expose only the portion of the rotary blade needed to cut. The insert 110*c* includes a central hole 420 that allows the manufacturer or user to attach the insert 110*c* to the rotary cutter. The attachment arms 600 stabilize the insert 110*c* when the insert 110*c* is attached to the rotary cutter. The shape and size of the attachment arms 600 are not limited to those shown in FIGS. 6A-6C.

One skilled in the art will appreciate that the rotary cutter inserts 110*a*, 110*b* and or 110*c* may be manufactured out of any suitable plastic, metal, or organic material. In at least one implementation, the rotary cutter inserts 110*a*, 110*b*, and or 110*c* are made of acrylic. In alternative embodiments, the rotary cutter inserts 110*a*, 110*b*, and or 110*c* are made of polycarbonate, polyvinylchloride, polyamid, cellulosic, styrene, polyethylene, or any other thermoplastic.

Further, one skilled in the art will appreciate that bodies 400 are not limited to the size and circular shape shown in FIGS. 4A-6C. In at least some embodiments, the width of the body 400 is within the range of $1/4^{th}$ to 5 mm. The manufacturer can size the body 400 to cover a 28 mm, 45 mm, or 60 mm rotary blade. In at least one additional or alternative implementation, the length of the body 400 is within the range of 10 to 100 mm.

The sized of the central hole 420 is also not limited to that shown in FIGS. 4A-6C. The diameter of the central hole 420 may vary depending on the securing means used to attach the rotary blade and the rotary cutter inserts 110*a*-110*c* to the rotary cutter. FIGS. 4A-4B and 6A-6C show a central hole 420, while FIGS. 5A-5B show a semi-circular central hole 420. The shape of the central hole 420 may be any shape suitable to allow the attachment of the rotary cutter inserts 110*a*-110*c* to the rotary cutter. Further, in at the least one alternative embodiment, the rotary cutter inserts 110*a*-110*c* do not have a central hole 420. The manufacturer or user can use any means that allows the attachment of the rotary cutter inserts 110*a*-110*c* to the rotary cutter. One skilled in the art will further appreciate that the angle of the angled cutout 410 is not limited to that shown in FIGS. 4A-6C.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A rotary cutting device comprising:

a body with a curved ridge defining a receiving area of the body, the curved ridge having an exposed outer end;

an insert defining a cutout, a projection connected to the insert, the projection having a flat surface that extends outwardly from the insert;

a rotary blade having a side surface;

the insert and the rotary blade are movably connected to the receiving area of the body via a connector so that the insert is disposed on the side surface of the rotary blade;

the insert covers a first portion of the side surface of the rotary blade, the cutout of the insert exposes a second portion of the side surface of the rotary blade;

the projection is always completely exposed and the flat surface is configured to contact the exposed outer end of the curved ridge; and the insert is only insert connected to the receiving area of the body via the connector.

2. The rotary cutting device of claim 1, wherein the rotary cutter insert comprises a central hole that receives the connector.

3. The rotary cutting device of claim 2, wherein the central hole is circular.

4. The rotary cutting device of claim 1, wherein the device comprises an acrylic.

5. The rotary cutting device of claim 1, wherein the device comprises a thermoplastic.

6. The rotary cutting device of claim 1, wherein a portion of the insert is substantially circular.

7. The rotary cutting device of claim 1, wherein the connector is configured to allow for the insert and the rotary blade to be removably connected to the receiving area of the body.

* * * * *